US006619568B2

(12) United States Patent
Kunkle et al.

(10) Patent No.: US 6,619,568 B2
(45) Date of Patent: Sep. 16, 2003

(54) MATERIAL DISPERSING DEVICE AND METHOD

(75) Inventors: Timothy Edward Kunkle, Erie, PA (US); David Joseph Hanlin, Jr., Edinboro, PA (US)

(73) Assignee: General Signal Corporation, Muskegon, MI (US)

( * ) Notice: Subject to any disclaimer, the term of this patent is extended or adjusted under 35 U.S.C. 154(b) by 0 days.

(21) Appl. No.: 09/873,285

(22) Filed: Jun. 5, 2001

(65) Prior Publication Data

US 2002/0179739 A1 Dec. 5, 2002

(51) Int. Cl.[7] ..... B05B 1/32; B05B 11/02

(52) U.S. Cl. ..... 239/452; 239/451; 239/456; 239/321

(58) Field of Search ..... 239/452, 451, 239/456, 459, 463, 468, 467, 476, 501, 487, 302, 308, 321, 322; 222/321.2, 321.7, 321.8, 321.9, 382

(56) References Cited

U.S. PATENT DOCUMENTS

| | | | | | |
|---|---|---|---|---|---|
| 4,164,326 | A | * | 8/1979 | Deckard | 239/124 |
| 4,192,466 | A | * | 3/1980 | Tanasawa et al. | 239/464 |
| 4,618,100 | A | * | 10/1986 | White et al. | 239/440 |
| 4,768,932 | A | | 9/1988 | Geberth, Jr. | 417/552 |
| 4,909,445 | A | | 3/1990 | Schoonover | 239/463 |
| 4,986,453 | A | | 1/1991 | Lina et al. | 222/321 |
| 5,336,451 | A | | 8/1994 | Lovick | 261/116 |
| 5,385,121 | A | | 1/1995 | Feiss | 112/459 |
| 5,439,619 | A | | 8/1995 | Kuffer | 261/41.4 |
| 5,544,816 | A | * | 8/1996 | Nally et al. | 239/585.5 |
| 5,579,958 | A | * | 12/1996 | Su | 222/321.2 |
| 5,713,327 | A | | 2/1998 | Tilton et al. | 123/299 |
| 6,044,688 | A | | 4/2000 | Dilger | 73/1.05 |
| 6,098,897 | A | * | 8/2000 | Lockwood | 239/8 |
| 6,186,417 | B1 | | 2/2001 | Ho et al. | 239/491 |
| 6,413,246 | B1 | * | 7/2002 | Harrold | 604/298 |

* cited by examiner

*Primary Examiner*—Davis Hwu
(74) *Attorney, Agent, or Firm*—Baker & Hostetler LLP

(57) ABSTRACT

A nozzle for delivering vaporized liquid material has a cylindrical housing with a central, cylindrical cavity having a fluid inlet and a fluid outlet. The nozzle also has a plunger inserted into the fluid outlet of the housing so that the plunger and the housing form a fluid path. The plunger is moveable between a first position and a second position. A plunger stop is attached to the housing at the fluid inlet. A spring retainer is attached to the plunger. At least one spring is disposed between the housing and spring retainer to urge the plunger towards the first position. A method includes the steps of biasing a plunger moveable relative to a housing, with a fluid passage defined by the housing and the plunger, towards a first position; and providing fluid pressure to the fluid passage to urge the plunger away from the first position.

24 Claims, 7 Drawing Sheets

MATERIAL DISPERSING DEVICE AND METHOD

FIELD OF THE INVENTION

The present invention relates generally to a material dispersing device and method. More particularly, the present invention relates to a nozzle for dispersing of material in a controlled manner.

BACKGROUND OF THE INVENTION

Steam generating systems frequently produce superheated steam and deliver that steam to utilization devices such as steam turbines or the like. Steam desuperheaters are used for reducing and controlling the temperature of a steam flow. There are several extremely good economic and technical reasons for desuperheating. Many devices that utilize steam are designed to operate with a supply of steam at a specified temperature. In addition, because superheated steam can reach temperatures that damage the utilizing devices, close control is maintained over the superheated temperature of the steam. Where the steam is produced at a temperature higher than that required, a desuperheater device can lower the temperature by spraying cooling water into the flow upstream of the steam utilizing device. Once sprayed into the steam flow, the cooling water evaporates, drawing energy from the steam and thereby lowering the steam temperature.

In some applications, fluid is injected in the same direction as the steam or compressible gas flow and a downstream sensor, typically a thermocouple, is used to measure the reduced temperature of the steam. The temperature difference between a predetermined setting and that sensed by the sensor, is converted to a control signal used to control the flow of water to the desuperheater device. Thus, temperature controllability of the steam is limited by a control valve used to restrict fluid flow to the desuperheater device. Efficient desuperheating use of the injected liquid is maximized by reducing the size of water droplets injected into the steam flow.

Many conventional desuperheaters simply inject or use fixed nozzles to spray cooling liquid directly into a flow of steam within a conduit such as a pipe. Although such devices have generally operated satisfactorily, many have suffered from the disadvantage that they provide insufficient control over the vaporization, thereby making it difficult to effectively and accurately control the steam temperature. For example, injected cooling water that does not quickly evaporate may collect at the bottom of the conduit and evaporate therefrom in an uncontrolled manner, making precise control of the steam temperature difficult. Furthermore, unvaporized water can cause erosion and thermal stresses in the pipe, resulting in failure of the pipe conduit.

Accordingly, it is desirable to provide a nozzle that allows for the injection of a cooling fluid into processed steam or compressible gas with additional mixing control capability. Similarly, there is a need for a nozzle that allows for precise temperature controllability of a compressible gas or processed steam.

SUMMARY OF THE INVENTION

The foregoing needs are met, to a great extent, by the present invention where, in one aspect, a nozzle for delivering liquid or compressible gas material has a cylindrical housing with a central, cylindrical cavity having a fluid inlet and a fluid outlet. The nozzle also has a plunger inserted into the fluid outlet of the housing so that the plunger and the housing form a fluid path. The plunger is variably moveable between a first position and a second position. A plunger stop is attached to the housing at the fluid inlet. A spring retainer is attached to the plunger. At least one spring is disposed between the housing and spring retainer to urge the plunger towards the first position.

In another aspect, the invention provides a method for delivering vaporized material in which the steps of biasing a plunger moveable relative to a housing, with a fluid passage defined by the housing and the plunger, towards a first position; and providing fluid pressure to the fluid passage to urge the plunger away from the first position are performed.

In another aspect, the invention provides the ability to control particle size of fluid discharge and control distribution of fluid and/or gas within a radial or circumferential discharge pattern.

In yet another aspect, the invention provides the ability to concentrate fluid and/or gas within the discharge pattern as desired.

In another aspect, the invention provides the ability to control the degree of the exit angle of the gas and/or liquid without having to physically alter the position or placement of the nozzle.

Although the above description illustrates a nozzle for dispersing fluid for desuperheating steam, the nozzle may be used for a wide variety of purposes, and the nozzle may be used to disperse a wide variety of materials. For example, in addition to fluid, the nozzle may be utilized to disperse solids, powders and/or gases. The nozzle may also be utilized for the cleaning of industrial equipment such as boilers and vessels. The nozzle may also be used to apply fluid to large surfaces and/or products ranging from pharmaceutical tablets to machinery.

There has thus been outlined, rather broadly, the more important features of the invention in order that the detailed description thereof that follows may be better understood, and in order that the present contribution to the art may be better appreciated. There are, of course, additional features of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein, as well as the abstract included below, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION OF PREFERRED EMBODIMENTS OF THE INVENTION

Figure 1:
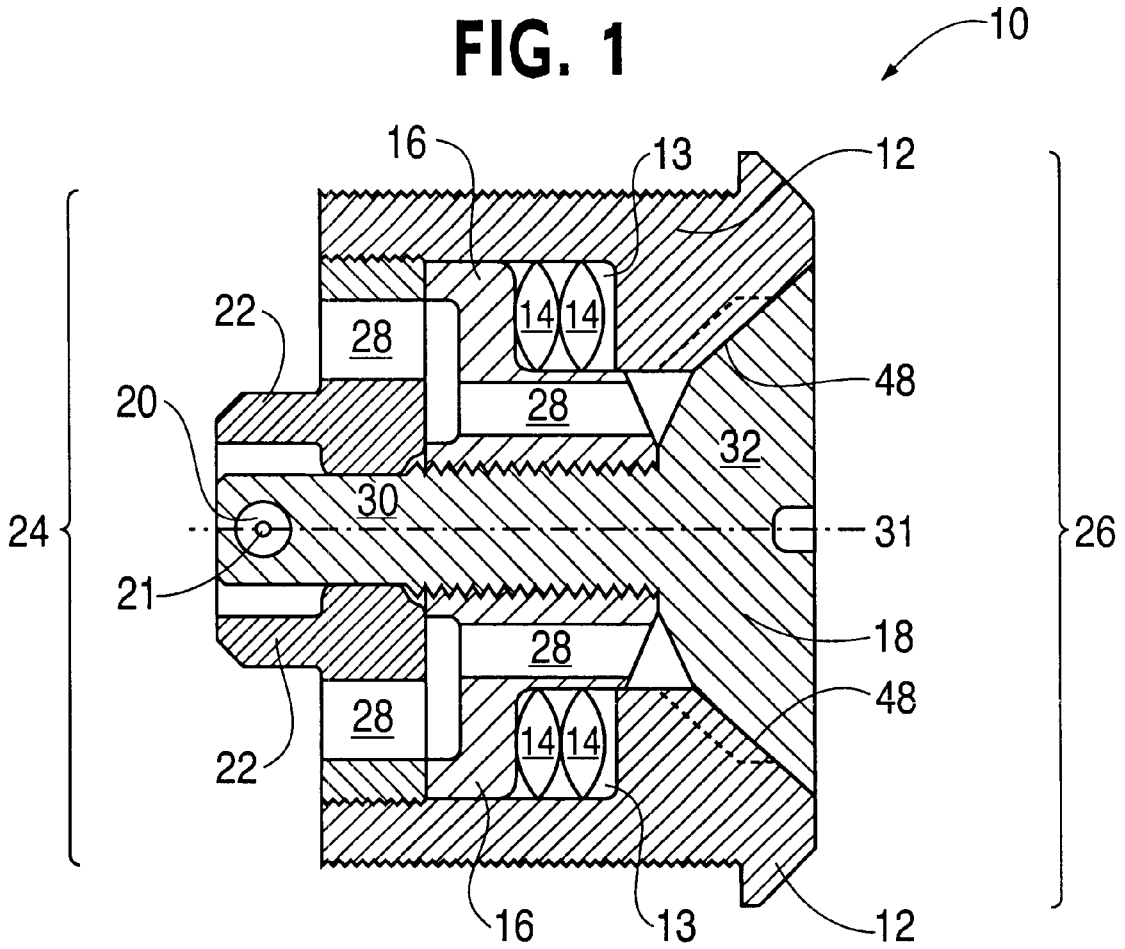
FIG. 1 is a cross-sectional view of the nozzle in a closed position.

Referring now to the figures wherein like reference numerals indicate like elements, FIGS. 1–12 illustrate the presently preferred embodiment of a low differential fluid or gas atomizing nozzle. While in the embodiment depicted the nozzle is used for the injection of cooling water into processed steam, it should be understood that the present invention is not limited in its application to steam conditioning.

Figure 2:
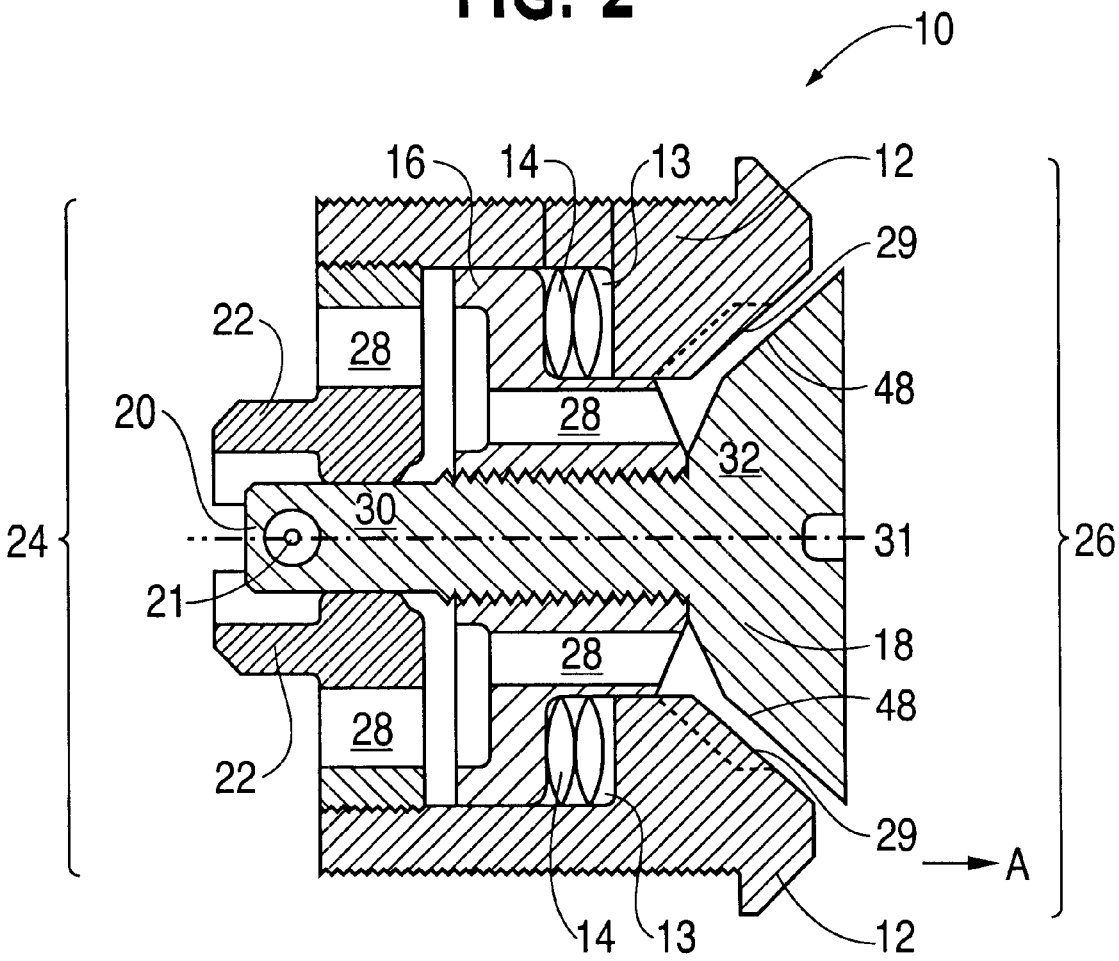
FIG. 2 is a cross-sectional view of the nozzle in an open position.

As shown in FIG. 1, the steam conditioning nozzle 10 of the present invention comprises a nozzle housing 12, a clearance 13 for holding at least one pair of disc springs 14, with the clearance 13 formed between the housing 12 and a spring retainer 16, a plunger 18 extending the length of the nozzle 10 having a first and second end, a pin bore 20 and plunger stop 22. The spring retainer 16 is threaded to the plunger 18 so they travel axially together. When assembled, the disc springs 14 provide a predetermined load against the fluid injection pressure by exerting an axial force against the spring retainer 16. The plunger 18 will be displaced in the direction A when the predetermined load exerted by the springs 14 is less than that of the fluid injection pressure, as shown in FIG. 2. The plunger 18 will be in the closed position shown in FIG. 1 when the predetermined load of the springs 14 is greater than that of the fluid injection pressure. The plunger 18 has a cylindrical bore 20 where a pin 21 may be inserted to control plunger 18 travel and displacement by contacting the plunger stop 22. The pin 21 rides within a pair of slots 23 in the plunger stop 22.

The nozzle 10 has an inlet face 24 located at one end of the housing 12 and an outlet face 26 on the other end, with the inlet face 24 and outlet face 26 having an axis perpendicular to the longitudinal axis of the housing 12. The inlet face 24 of the nozzle 10 includes a first end of the nozzle housing 12, a first end of the plunger 18 and a first end of the plunger stop 22. Extending between the inlet face and the outlet face within the nozzle housing 12 are a plurality of flow passages 28. The flow passages extend parallel to the longitudinal axis of the housing within the spring retainer 16 and plunger stop 22 and lead to a diverging passage at the head of the plunger 32. The passages 28 are radially located in between the plunger shaft slot 40 and the housing 12.

In the preferred embodiment, the inlet face 24 is threaded into a water supply line thereby providing communication of water from a water source to the flow passages 28. The outlet face of the nozzle 10 includes the housing 12 and the head of the plunger 18. The outlet face 26 comprises a cylindrical section of the housing 12 having an inner surface 29 with the diameter of the cylindrical section reducing as the inner surface 29 extends inward.

FIG. 1 shows the nozzle 10 in the fully closed position which may be due to either a lack of communication of water to the flow passages 28 or the injection fluid pressure being less than that of the pre-determined force exerted by the disc springs 14. Therefore the force exerted upon the spring retainer 16 displaces the plunger 18 into a the first position where the base of the head of the plunger 32 snugly fits within the region of reduced diameter of the housing 12, reducing and/or stopping fluid flow. This action essentially acts as a liquid flow shutoff, blocking all liquid flow through the flow passages 28 when the head of the plunger 32 occupies the aforementioned position. As shown in FIG. 2, the nozzle 10 is moved from the fully closed position (as shown in FIG. 1) to an open position by the displacement of the plunger 18. The above described displacement is due to the water supply line providing communication from the water source to the flow passages 28 combined with the injection pressure of the water overcoming the predetermined force exerted by the disc springs 14.

Whether cooling water is allowed to enter the inlet face 24 and proceed through the flow passages 28 to the outlet face 26 and variations in plunger displacement, is a function of the disc springs 14 and the pin 21 location. The nozzle 10 utilizes a plurality of disc springs 14 inserted into the clearance 13 in a parallel arrangement. The springs 14 provide for a controlled displacement of the plunger 18 as a function of the differential pressure between the predetermined force of the springs 14 and the injection force of the fluid.

The pin 21 (Not shown) may be inserted into the cylindrical bore 20 of the plunger shaft 30 and rides in the slot 23 (See FIG. 6) so as to precisely limit plunger 18 travel and to avoid excess disc spring stress. In addition, the insertion of the pin 21 in the slot 23 prevents rotation of the plunger 18 about the longitudinal axis of the nozzle. The plunger 18 has a tool receiving slot 31 that permits the plunger 18 to be rotated to adjust its axial position relative to the spring retainer 16.

Figure 3:
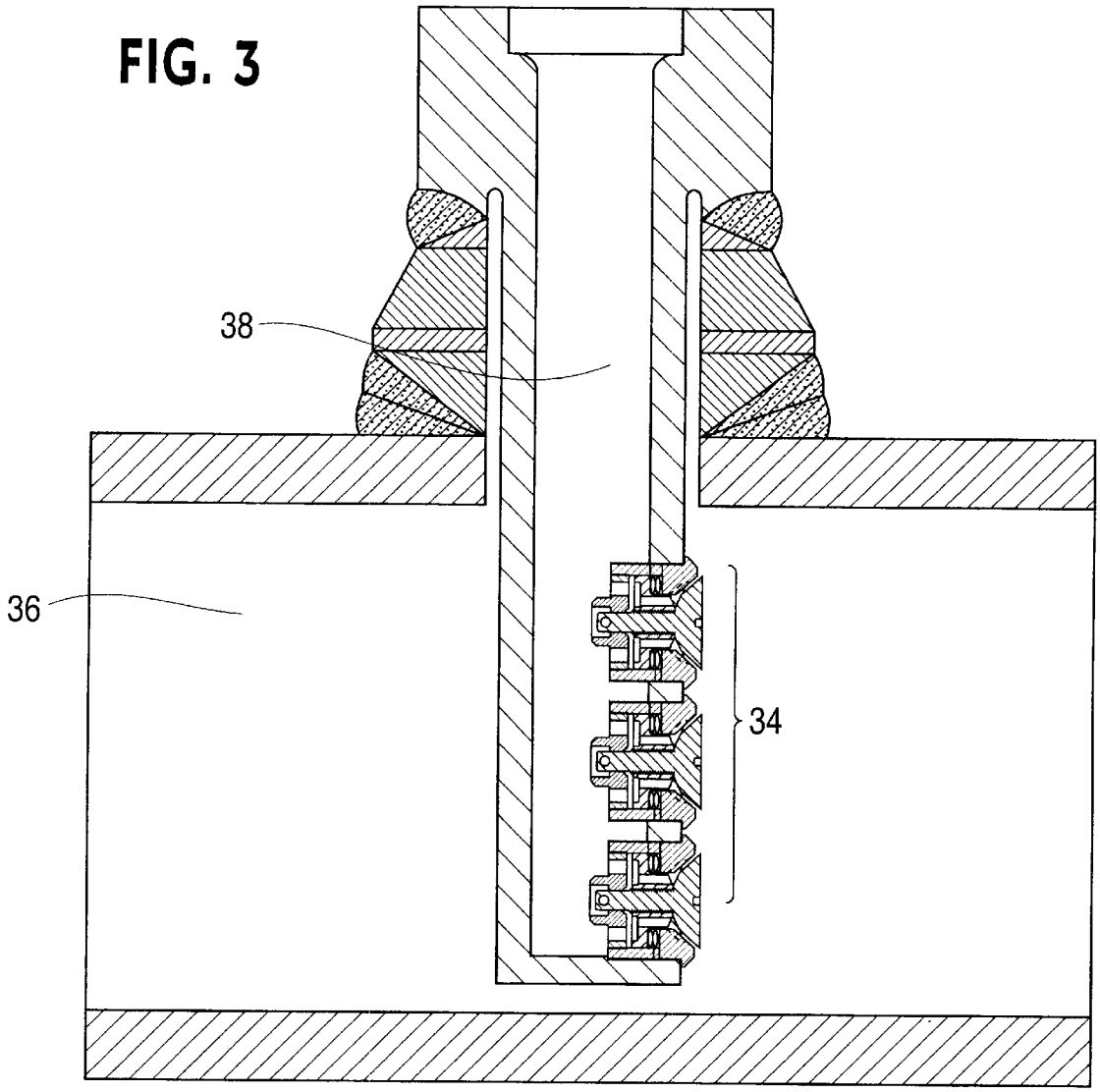
FIG. 3 is a cross-sectional view of a plurality of nozzles mounted into a spray tube with the spray tube inserted into a steam conduit.

FIG. 3 shows a simple and economical steam conditioning apparatus 34, inserted into a steam conduit 36, particularly suited for many applications for reducing temperature of superheated steam. A plurality of nozzles 10 are arranged vertically and threaded into a water supply conduit 38 and preferably tack welded to fix in place so that the direction of spray will be with the flow of steam in the conduit 36. The nozzles illustrated in FIG. 3 do not require individual valve means to control the flow of water to each nozzle. Instead, the flow of liquid and eventual spray of cooling liquid is a function a valve means which may be provided either at the water source or along the water supply conduit 38 and the use of different spring configurations to achieve variations in nozzle opening differential. This allows the nozzles to and open and close as a function of differential pressure between the fluid and/or gas and the disc springs.

Note that when the nozzles are placed in a series as depicted in FIG. 3, there is an overlap in patterns which results in diffraction and the combination of particles to form larger particles. This occurrence is undesired for the given application and the present invention allows for the minimizing of nozzle discharge at specific locations to reduce diffraction.

Figure 4:
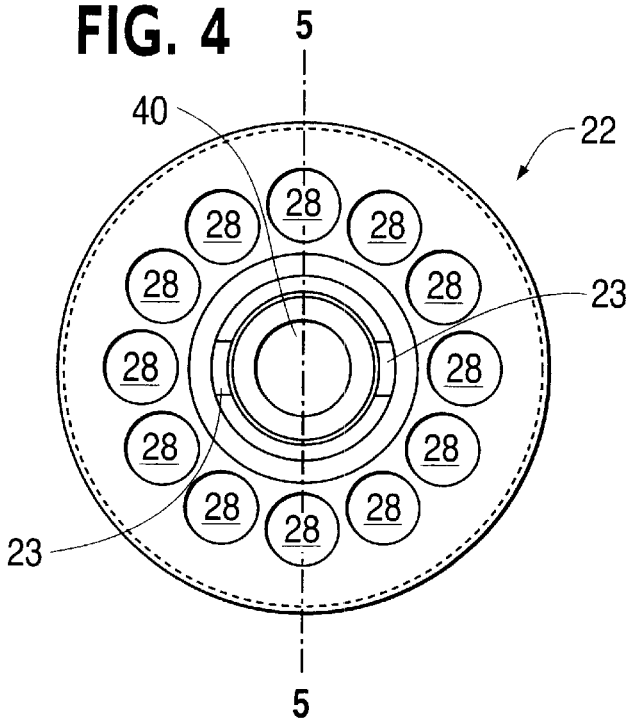
FIG. 4 is an end view of the plunger stop of the present invention.

FIG. 4 is a cross-sectional view of the plunger stop 22 showing the radial orientation of a plurality of flow passages 28 about the longitudinal axis of the housing 12. The passages 28 extend parallel to longitudinal axis of the housing 12 and are located outside the bore 40 where the plunger shaft 30 is inserted.

Figure 5:
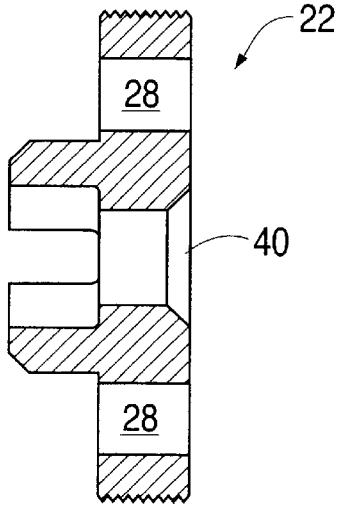
FIG. 5 is a cross-sectional view of the plunger stop of the present invention along line 5—5 of FIG. 4.

FIG. 5 is a sectional view of the plunger stop 22 taken along line 5—5 of FIG. 4 showing the flow passages 28 located within the plunger stop 22 and having h first diameter. The flow passages 28 are oriented parallel to the longitudinal axis of the housing 12.

Figure 6:
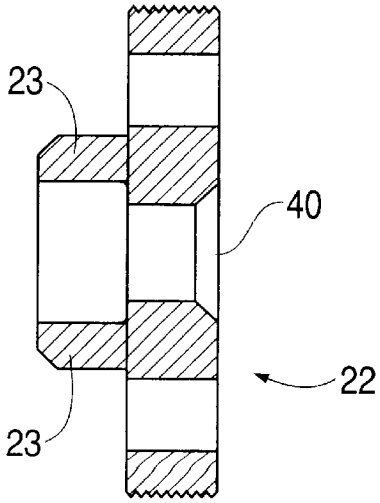
FIG. 6 is a cross-sectional view of the plunger stop taken along line 6—6 of FIG. 4.

FIG. 6 shows the slots 23 that permit travel of the pin 21 while serving as a stop for pin travel to limit full extension of the plunger 18. The threaded connection of the plunger 18 with the spring retainer 16 permits adjustment of the maximum nozzle travel, and also of the spring force at a given displacement for a given spring constant. The selection of spring constant further permits adjustment of nozzle characteristics.

Figure 7:
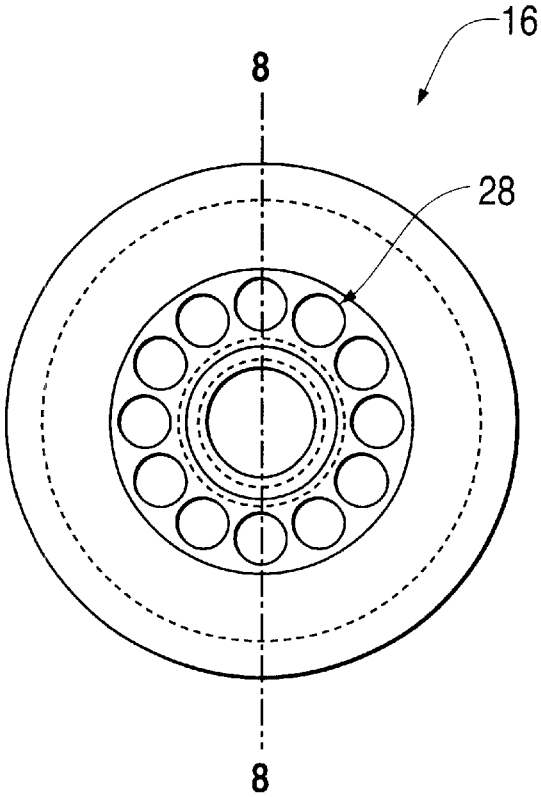
FIG. 7 is an end view of the spring retainer of the present invention.

FIG. 7 is an end view of the spring retainer 16 showing the radial orientation of a plurality of flow passages 28 about the longitudinal axis of the housing 12.

Figure 8:
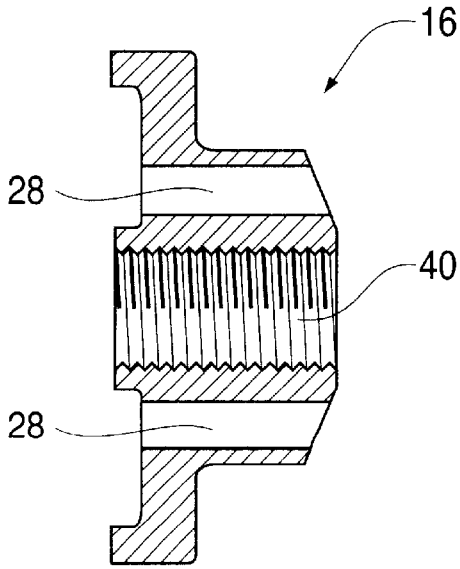
FIG. 8 is a cross-sectional view of the spring retainer of the present invention along line 8—8 of FIG. 7.

FIG. 8 is a cross-sectional view of the spring retainer 16 taken along line 8—8 of FIG. 7 showing the flow passages 28 located within the spring retainer 16 having and a second diameter. The flow passages 28 are oriented parallel to the longitudinal axis of the housing 12.

Figure 9:
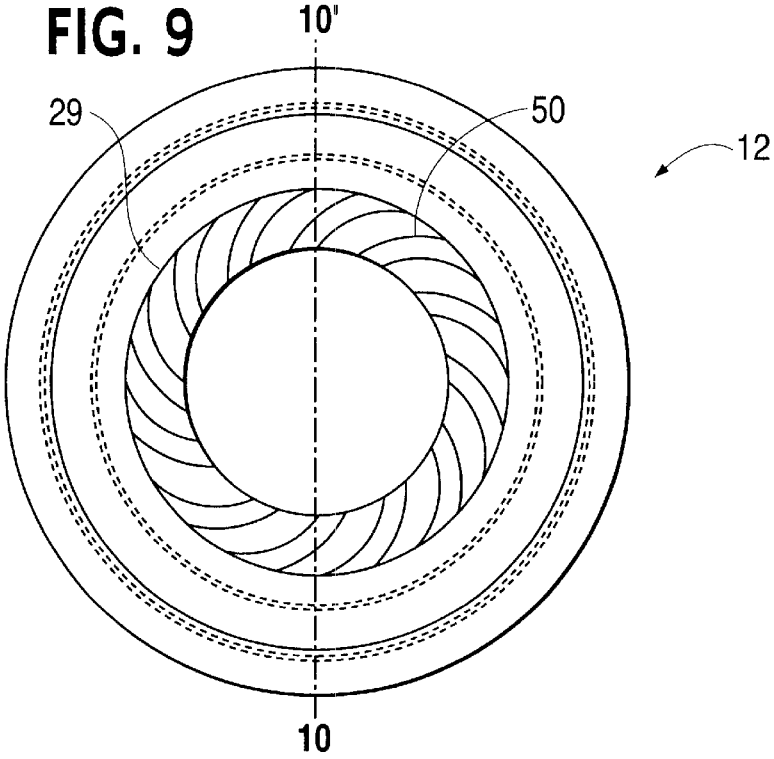
FIG. 9 is an end view of the nozzle housing with the plunger removed showing the spiral, radial grooves of the inner surface of the housing.

FIG. 9 is an end view of the outlet face 26 of the nozzle 12 upon which a plurality of spiral, radial grooves 50 are located. The interior region has a cylinder throat 44 with an orientation parallel to the longitudinal axis of the nozzle housing 12. The throat 44 has an increasing diameter creating an inner, diverging surface 29 (See FIG. 10) of the housing 12. Liquid enters the interior region via the flow passages 28 located within the spring retainer 16.

Figure 10:
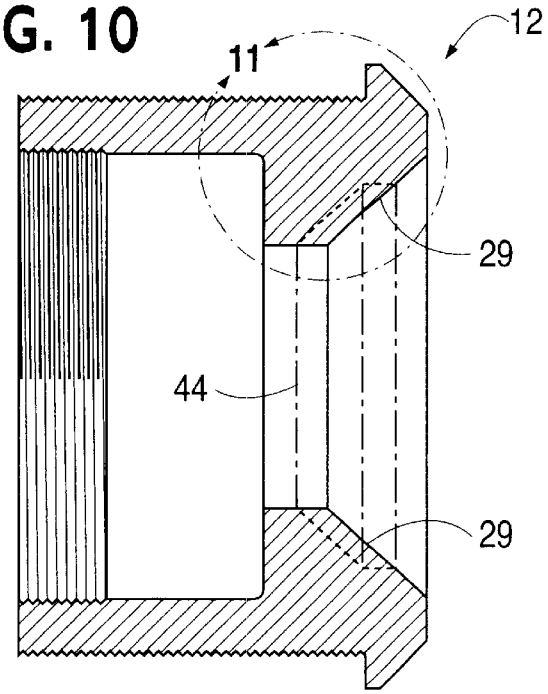
FIG. 10 is a sectional view of a nozzle housing taken along line 10—10 of FIG. 9.

FIG. 10 is a sectional view taken along line 10—10 of FIG. 9 showing the throat 44 and the inner, diverging surface 29.

Figure 11:
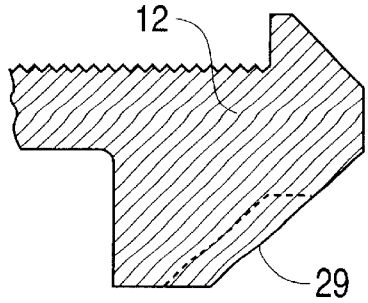
FIG. 11 is a detail view of the angular face of the nozzle housing shown in FIG. 9, indicated by detail 11 in FIG. 9.

FIG. 11 is a detail view of the increasing diameter from the throat 44 which creates the inner, diverging surface 29 of shown in FIG. 10.

Figure 12:
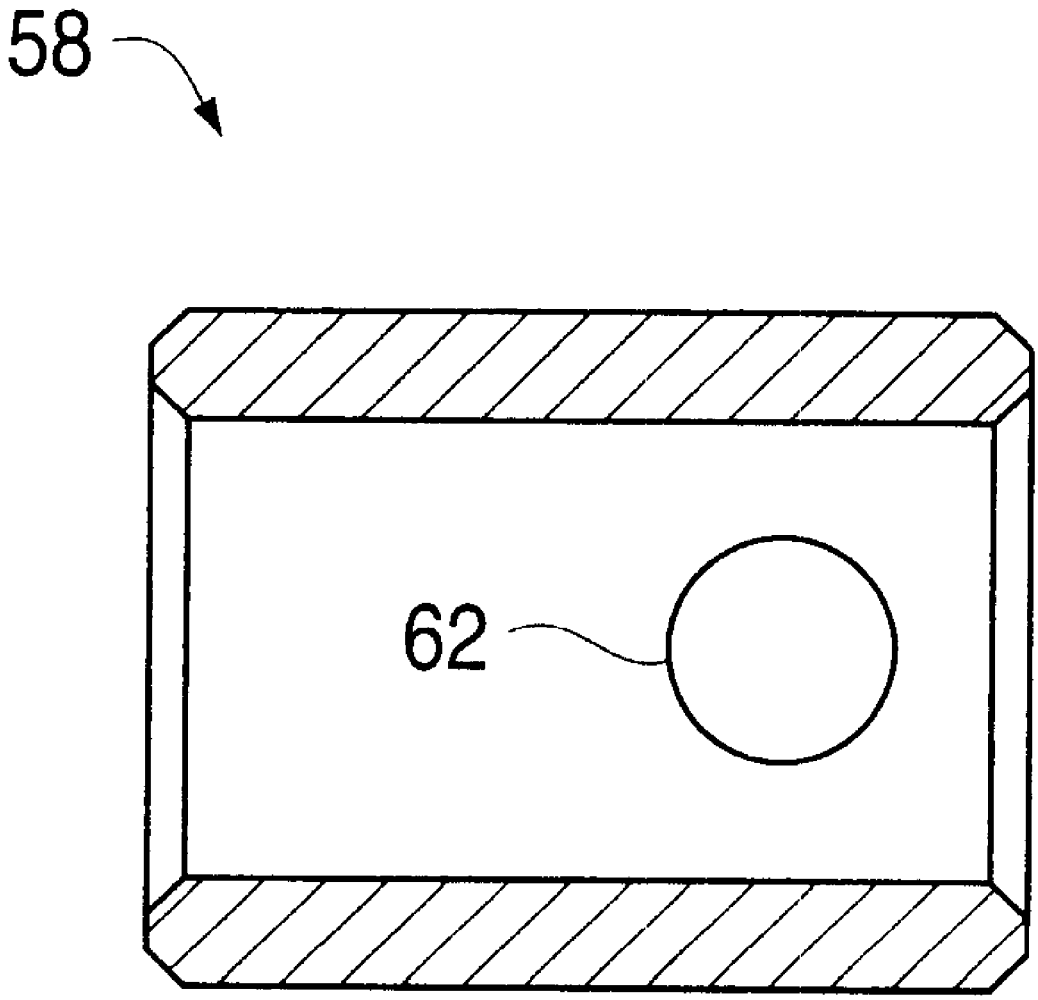
FIG. 12 is a detail view of the tool utilized to situate the cylindrical bore in the plunger shaft.

FIG. 12 is a detail view of the tool 58 utilized to situate the cylindrical bore 20 in the plunger shaft 30. The tool 58, has a pilot hole 62 for prescribing the drilling location of the cylindrical bore 20 into the plunger shaft 30. The plunger stop 22 has a counter bore with a width greater than that of the outer diameter of the tool 58, enabling the tool to slide inside the counter bore. This described placement of the tool within the counter bore enables the cylindrical bore 20 to be placed accurately and precisely so as to limit plunger 18 travel and displacement according to application criteria.

As shown in FIGS. 1–11, the diverging surface 29 from the throat 44 communicates with the converging surface 48 of the plunger head 32 to create controlled radial or circumferential exit paths that may extend from the spring retainer 16 to the outlet face 26. The varying diameters therefore produce varying liquid flow areas. In addition, the communication may be such that the diverging surface 29 and converging surface 48 are in direct contact preventing the existence of flow channels that may extend from the spring retainer 16.

The aforementioned communication and resulting variation in diameter is direct a function of the displacement of the spring retainer 16 relative to the plunger stop 22. In the fully closed position as shown in FIG. 2, the plunger stop 22 is in the resting position where the converging surface 48 is in direct contact with diverging surface 29 preventing the existence of flow through the flow channels. In an open position where the converging and diverging surfaces 48, 29 create a controlled radial or circumferential exit path, liquid entering the throat 44 through the flow passages 28 attains a spinning or swirling movement within the throat due to the spiral radial grooves 50, enhancing the cooling characteristics of the fluid flowing through the nozzle.

The cooling of processed steam or compressible gas is a direct function of the mixing efficiency of the cooling fluid with the processed steam or compressible gas. The mixing efficiency is a function of droplet size distribution exiting the nozzle 10 with the smallest mean size desired. Small average fluid particle size and the subsequent improved mixing efficiency may be attained by creating a turbulent flow area just prior the exit of the cooling fluid through the outlet face 26 and controlling the exit annulus (minimizing plunger travel). The turbulent flow causes the fluid to exit the nozzle in very small particles through the controlled radial or circumferential exit paths. This may be accomplished by etching, milling and/or burning a series of patterns in the diverging surface 29 from the throat 44 such as radial, spiral grooves 50 and/or boring a series of patterns in the converging surface 48 in the plunger stopper head 32. These patterns may vary depending upon nozzle application criteria.

In the preferred embodiment, the spiral grooves 42 may be provided in a left hand or right hand direction. Alternatively, lateral grooves and/or patterns may be provided equally spaced about the about converging and/or diverging surfaces. Converging grooves may also be provided. In addition, patterns may be placed non-symmetrically upon the surfaces permitting greater flow and less flow across the specific surfaces of the nozzle. For example, one pattern may be placed around a partial arcuate sweep of the surface and another pattern around the remaining arcuate sweep. Depending upon the application criteria, patterns may be applied to either or both of the surfaces.

A change in the diameter of the flow channels created by displacement of the plunger stop, results in a proportional change in the time the fluid is in contact with the patterns bored upon the converging and diverging surfaces. Therefore, the further the plunger head 32 is displaced away from the diverging surface 29 of the housing 12, the larger the average fluid particle size exiting the nozzle 10.

The above description and drawings are only illustrative of preferred embodiments which achieve the objects, features, and advantages of the present invention, and is not intended that the present invention be limited thereto. Any modification of the present invention which comes within the spirit and scope of the following claims is considered to be part of the present invention.

What is claimed is:

1. A nozzle for delivering material comprising:

a cylindrical housing with a central, cylindrical cavity having a material inlet and a material outlet;

a plunger inserted into said material outlet of said housing so that said plunger and said housing form a flow path; said plunger is moveable between a first position and a second position, wherein said plunger has a cylindrical bore in which a pin is inserted, limiting the travel of said plunger and preventing rotation of said plunger;

a plunger stop attached to said housing at said material inlet;

a spring retainer attached to said plunger; and at least one spring disposed between the housing and spring retainer to urge the plunger towards the first position.

2. The nozzle according to claim 1, wherein said material is liquid.

3. The nozzle according to claim 1, wherein said housing has an inner, diverging surface.

4. The nozzle according to claim 3, wherein said inner, diverging surface has said geometric patterns thereon.

5. The nozzle according to claim 1, wherein said plunger has a converging surface opposed to said diverging surface.

6. The nozzle according to claim 5, wherein said converging surface has said geometric patterns thereon.

7. The nozzle according to claim 1, wherein said plunger is selectively adjustable to vary characteristics of the flow path.

8. The nozzle according to claim 1, wherein each said spring provides controlled displacement of said plunger in response to a predetermined minimum amount of material flow supplied to said nozzle.

9. The nozzle according to claim 1, wherein said plunger stop further comprises a first set cylindrical flow passages with a first diameter.

10. The nozzle according to claim 1, wherein said spring retainer further comprises a second set of cylindrical flow passages.

11. The nozzle according to claim 1, wherein said pattern is symmetrical.

12. The nozzle according to claim 1, wherein said pattern is non-symmetrical.

13. A nozzle for delivering material comprising:

a cylindrical housing with a central, cylindrical cavity having a material inlet and a material outlet;

a plunger inserted into said material outlet of said housing so that said plunger and said housing form a flow path; said plunger is moveable between a first position and a second position, wherein said plunger has a cylindrical bore in which a pin is inserted, limiting the travel of said plunger and preventing rotation of said plunger; and biasing means for biasing the plunger toward the first position.

14. The nozzle according to claim 13, wherein said material is liquid.

15. The nozzle according to claim 13, wherein said housing has an inner, diverging surface.

16. The nozzle according to claim 15, wherein said inner, diverging surface has geometric patterns thereon.

17. The nozzle according to claim 15, wherein said plunger has a converging surface opposed to said inner diverging surface.

18. The nozzle according to claim 17, wherein said plunger has a converging surface opposed to said diverging surface.

19. The nozzle according to claim 13, wherein said plunger is selectively adjustable to vary characteristics of the flow path.

20. The nozzle according to claim 13, wherein said biasing means provides controlled displacement of said plunger in response to a predetermined minimum liquid flow supplied to said nozzle.

21. A method for delivering material comprising the steps of:

biasing a plunger moveable relative to a housing, with a flow passage defined by the housing and the plunger, towards a first position; and providing material pressure to the flow passage to urge the plunger away from the first position, wherein said plunger has a cylindrical bore in which a pin is inserted, limiting the travel of said plunger and preventing rotation of said plunger.

22. The method according to claim 21, wherein said material is liquid.

23. The method according to claim 21, wherein the first position is a closed position.

24. The method according to claim 21, further comprising the step of limiting the travel of the plunger relative to the housing away from the first position.

* * * * *